US005679024A

United States Patent [19]

Seki

[11] Patent Number: 5,679,024

[45] Date of Patent: Oct. 21, 1997

[54] CONNECTOR

[75] Inventor: Yoshinobu Seki, Shizuoka, Japan

[73] Assignee: Yazaki Corporation, Tokyo, Japan

[21] Appl. No.: 680,071

[22] Filed: Jul. 15, 1996

Related U.S. Application Data

[63] Continuation of Ser. No. 275,418, Jul. 15, 1994.

[30] Foreign Application Priority Data

Jul. 22, 1993 [JP] Japan ..... 5-201312

[51] Int. Cl.[6] ..... H01R 13/40

[52] U.S. Cl. ..... 439/595; 439/752

[58] Field of Search ..... 439/595, 752, 439/594, 597, 598, 603

[56] References Cited

U.S. PATENT DOCUMENTS

| | | | |
|---|---|---|---|
| 4,826,452 | 5/1989 | Sian et al. | 439/595 |
| 4,950,182 | 8/1990 | Zielinski et al. | 439/595 |
| 5,224,877 | 7/1993 | Yamamoto | 439/595 |
| 5,511,991 | 4/1996 | Seki | 439/595 |
| 5,520,552 | 5/1996 | Seki | 439/595 |

FOREIGN PATENT DOCUMENTS

| | | | |
|---|---|---|---|
| 3633358 | 4/1988 | Germany . | |
| 3103572 | 10/1991 | Japan | H01R 13/64 |
| 4-24271 | 2/1992 | Japan | H01R 13/42 |
| 3103572 | 7/1993 | Japan . | |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

In a connector, metal terminals are held against withdrawal by a retainer, and projections on the retainer are engaged respectively with projections formed at that portion where the retainer is inserted. By doing so, the retainer is retained provisionally and completely. A plurality of spaced elongate arms are formed on the retainer, and fitting projections, formed on the opposite ends of the arms, are received respectively in predetermined grooves, thereby restraining the movement of the retainer in any direction except for predetermined directions.

7 Claims, 6 Drawing Sheets

CONNECTOR

This is a Continuation of application Ser. No. 08/275,418 filed Jul. 15, 1994.

BACKGROUND OF THE INVENTION

1. Filed of the Invention

This invention relates to a connector used in wiring in an automobile.

2. Related Art

There is known a conventional connector of this type in which when a metal terminal to which a wire is connected is to be inserted into and retained on a connector housing, a retainer is attached to the connector housing so as to prevent the movement of an elastic retaining piece formed on the connector housing for preventing the withdrawal of the metal terminal.

For example, Japanese Utility Model Unexamined Publication No. 3-103572 shows in FIGS. 7 (*a*) and (*b*) a construction in which a retainer 112 of the multi-interconnecting type is fitted in a connector housing 102.

In order to reduce the cost and also to facilitate the handling, the retainer 112 of the multi-interconnecting type comprises a plurality of base portions 110A interconnected in a row by connecting portions 111, each of the base portions having a pair of lock arms 10*e* and 10*f*. In this construction, each pair of lock arms 10*e* and 10*f* correspond to a pair of metal terminals 103 and 103. Each pair of metal terminals correspond to one fuse circuit. Therefore, each pair of lock arms correspond to one fuse circuit.

Therefore, when the metal terminals of the fuse circuits and associated wires are to be checked, or when a defective part must be exchanged, it is necessary to remove such wires and metal terminals. However, in the case of the above retainer of the multi-interconnecting type designed to retain the metal terminals of the plurality of fuse circuits, when one metal terminal is to be removed, all of the locking engagements of the plurality of metal terminals retained by the retainer of the multi-interconnecting type must be released. Such releasing operation and a re-engagement operation can not be effected easily, and therefore the maintenance is quite cumbersome, and this is not desirable.

Therefore, in order to facilitate the removal of one metal terminal, there has been proposed a single interconnecting-type retainer as disclosed in Japanese Utility Model Unexamined Publication No. 4-24271. A problem with such a construction is that the condition of provisional retaining of such a conventional single interconnecting-type retainer on a connector housing is very unstable. Such an unstable retaining condition of the conventional single interconnecting-type retainer will now be described.

A conventional single interconnecting-type retainer 104 shown in FIG. 8 has two lock arms 110*a* and 110*b*, and is fitted in between inner walls 103*a* and 103*b* of a housing 102, and are retained by them.

Projections 109*a* and 109*b* are formed respectively on the inner walls 103*a* and 103*b*, and are spaced different distances from their upper ends, respectively. Projections 111*a* and 111*b*, formed respectively on the two lock arms 110*a* and 110*b*, are retainingly engaged with the projections 109*a* and 109*b*, respectively.

FIG. 8 shows a condition in which the single interconnecting-type retainer 104 is provisionally-retained on the housing 102, and in this condition an upwardly-directed upper end of the projection 111*a* is engaged with the projection 109*a* whereas a downwardly-directed lower end of the projection 111*b* is engaged with the projection 109*b*, so that the single interconnecting-type retainer 104 is retained on the housing 102 only by the lock arm 110*a*.

As a result, the lock arm 110*a* is liable to move downward whereas the lock arm 110*b* is liable to move upward. Therefore, the retainer 104 is liable to angularly move in a direction β in FIG. 8, and hence is held in an unstable condition. When the retainer is further pushed downward so as to achieve a completely-retained condition, the projection 111*b* of the lock arm 110*b* slides on the projection 109*b* of the inner wall 103*a*, so that the retainer 104 is brought into a more unstable condition, and is liable to angularly move in a direction α in FIG. 8.

Therefore, there has been encountered a problem that when delivering or transporting the connector with the retainer held in its provisionally-retained condition, the retainer is liable to be disengaged from the connector.

Another drawback is that when the retainer is to be shifted from its provisionally-retained to its completely-retained condition, the retainer is liable to be angularly moved, that is, displaced, so that the efficiency of the operation is low.

SUMMARY OF THE INVENTION

With the above problems in view, it is an object of this invention to provide a connector in which a retainer, held in its provisionally-retained condition, will not be disengaged during storage or transportation, and the retainer will not tilt during the retaining of the retainer.

The above object has been achieved by a connector wherein metal terminals are retained respectively by metal terminal retaining projections on elastic retaining pieces provided between a pair of front and rear terminal receiving chambers for receiving the inserted metal terminals, respectively; a connector housing has projections for provisionally or completely retaining an inserted retainer which projections are formed respectively on right and left support walls arranged in a direction perpendicular to the direction of arrangement of the pair of front and rear terminal receiving chambers; the retainer has lock arms which are formed on a base portion thereof in a cantilever manner, and has projections, respectively; and the inserted retainer is retained by the right and left support walls; wherein vertically-extending fitting grooves are formed in front and rear inner walls of the connector housing extending in the direction perpendicular to the direction of arrangement of the pair of front and rear terminal receiving chambers, and are disposed at right and left positions between which the terminal receiving chambers are disposed; arms are formed respectively on right and left portions of the base portion at an upper portion thereof, and extend perpendicular to the base portion; and fitting projections, formed respectively on opposite ends of the arms, are received respectively in the fitting grooves, so that the retainer is movable upward and downward in the housing.

When the retainer is to be attached to or detached from the connector, the fitting projections, formed respectively on the opposite ends of the arms which are formed respectively on the right and left portions of the base portion at the upper portion thereof, and extend perpendicular to the base portion, are received respectively in the vertically-extending fitting grooves which are formed in the front and rear inner walls of the connector housing extending in the direction perpendicular to the direction of arrangement of the pair of front and rear terminal receiving chambers, and are disposed at the right and left positions between which the terminal receiving chambers are disposed. With this construction, the retainer is moved upward and downward along the fitting grooves in the housing.

For provisionally retaining the retainer, the retainer is inserted and moved downward to be provisionally retained. At this time, when the projections, formed respectively on the right and left support walls arranged in the direction perpendicular to the direction of arrangement of the pair of front and rear terminal receiving chambers, are provisionally engaged respectively with the projections formed on the lock arms formed in a cantilever manner on the base portion of the retainer, an asymmetrical force tending to tilt the retainer is produced; however, since the ends of the pair of arms formed on the upper portion of the retainer are received respectively in the fitting grooves, this arrangement resists the asymmetrical force tending to tilt the retainer, thereby preventing the retainer from being tilted.

BRIEF DESCRIPTION OF THE DRAWINGS

FIG. 2(*b*) a front-elevational view thereof;

FIG. 2(*c*) a side-elevational view thereof;

FIG. 3(*b*) is a front-elevational, cross-sectional view of an important portion in this condition;

FIG. 5 (*b*) is a front-elevational, cross-sectional view of an important portion in this condition;

FIG. 6(*b*) is a front-elevational, cross-sectional view of an important portion in this condition;

DETAILED DESCRIPTION OF THE PREFERRED EMBODIMENTS

Figure 1:
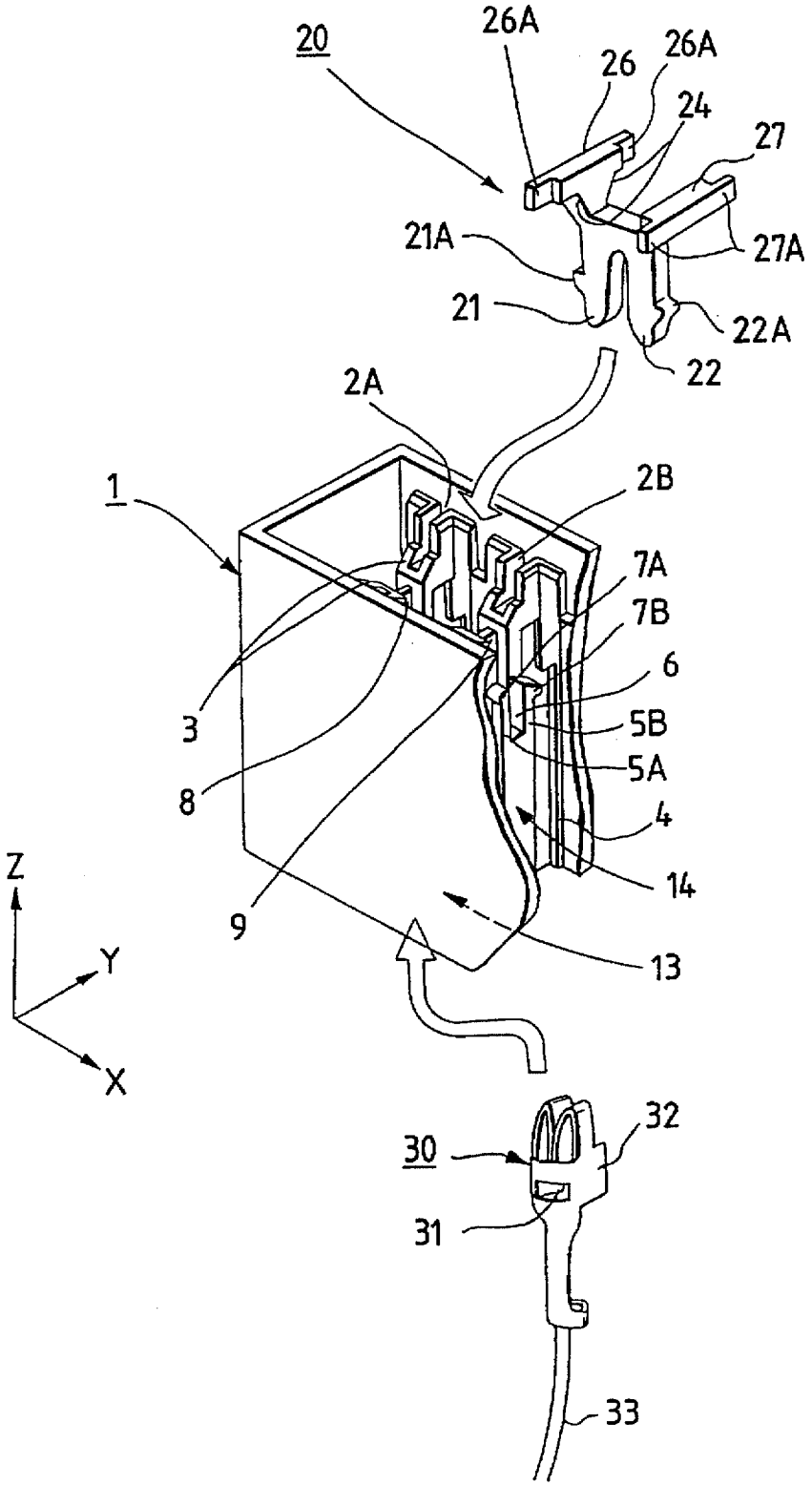
FIG. 1 is a perspective view showing an overall construction of a preferred embodiment of a connector of the present invention.

One preferred embodiment of the present invention will now be described with reference to the drawings.

In this embodiment, a connector of the present invention is applied to a fuse box in which one fuse circuit is formed by a pair of metal terminals.

Reference is first made to the construction of the embodiment of this embodiment. For illustration purposes, an X-axis represents a right-left direction, a Y-axis represents a forward-backward direction, and a Z-axis represents an upward-downward direction.

A connector housing 1 comprises a box-like body made of an electrically-insulative synthetic resin, and has pairs of front and rear terminal receiving chambers 13 and 14 each for receiving a metal terminal 30 inserted thereinto along a guide groove 4 from the lower side thereof.

The metal terminal 30 is received in each of the pair of front and rear terminal receiving chambers 13 and 14, thereby forming one circuit. In actual use, a plurality of pairs of front and rear terminal receiving chambers 13 and 14 are usually provided in a row in the right-left direction.

A pair of elastic retaining pieces 5A and 5B are provided between the pair of front and rear terminal receiving chambers 13 and 14, and are spaced from each other by a gap 6. These retaining pieces 5A and 5B have metal terminal retaining projections 7A and 7B, respectively, which retain the pair of metal terminals 30 and 30, respectively.

Projections 8A and 9A for provisionally or completely retaining an inserted retainer 20 are formed respectively on support walls 8 and 9 arranged in a direction (right-left direction) perpendicular to the direction (forward-backward direction) of arrangement of the terminal receiving chambers 13 and 14. Slanting walls 3 provided above the support walls 8, 9 are engaged with slanting surfaces 24 of the retainer 20.

Vertically-extending fitting grooves 2A, 2B (2C and 2D are not shown) are formed in front and rear inner walls of the connector housing 1 extending in the right-left direction, and are disposed at right and left positions between which the terminal receiving chambers 13 and 14 are disposed between. Therefore, the four fitting grooves are provided for the pair of metal terminals 30 and 30.

Figure 2A:
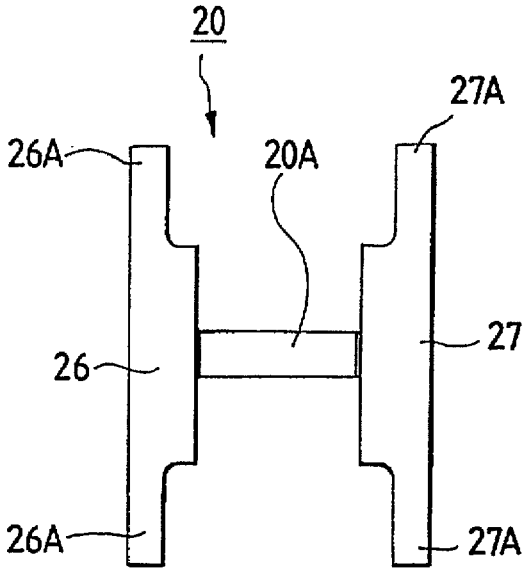
FIG. 2 (*a*) is a top plan view of a retainer of FIG. 1.
Figure 2B:
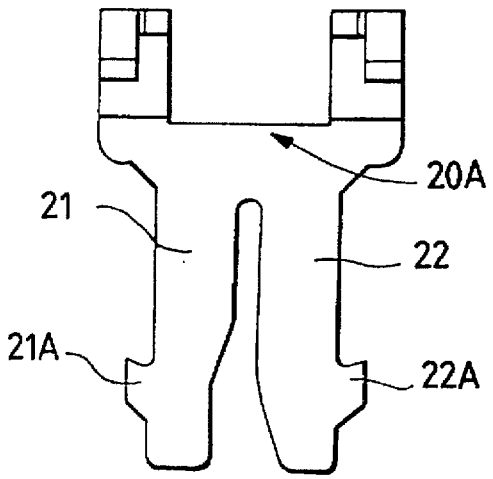
Figure 2C:
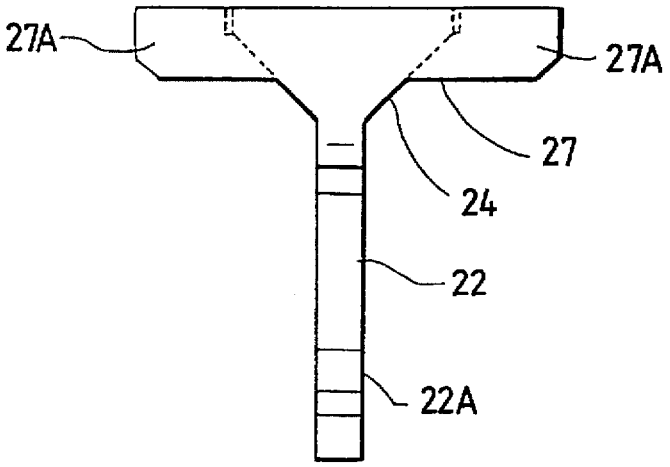

The retainer 20 is made of an elastic synthetic resin, and as shown in FIGS. 2 (*a*) to (*c*), two lock arms 21 and 22 of a cantilever construction are formed on right and left ends of a base portion 20A, respectively, and outwardly-directed projections 21A and 22A are formed on the two lock arms, respectively.

Arms 26 and 27 are formed respectively on the opposite ends of the base portion 20A at an upper end thereof, these arms extending in the forward-backward direction. Fitting projections 26A and 26A are formed on opposite ends of the arm 26, respectively, and fitting projections 27A and 27A are formed on opposite ends of the arm 27, respectively.

When the retainer 20 is to be attached to or detached from the connector housing 1, the four fitting projections 26A, 26A, 27A and 27A of the retainer 20 are received in the four fitting grooves 2A, 2B, 2C and 2D, so that the retainer is movable upward and downward along these fitting grooves in the housing.

The operation of the retainer will now be described.

Figure 3B:
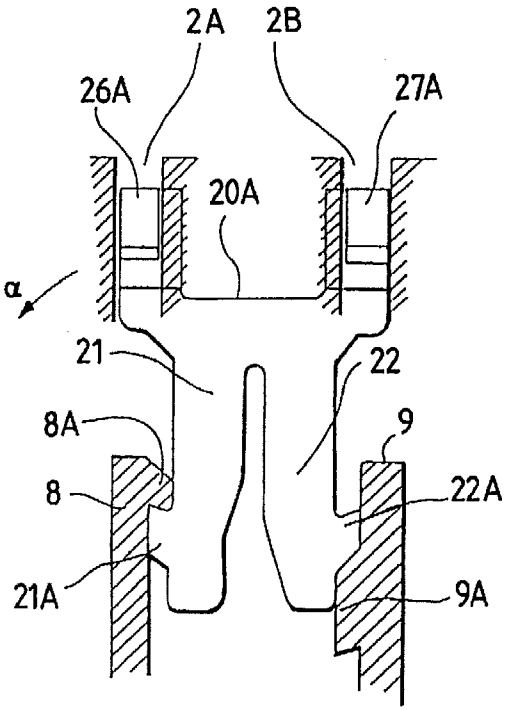
FIG. 3 (*a*) is a side-elevational, cross-sectional view of a connector housing having the retainer provisionally retained thereon, with metal terminals not yet retained.
Figure 3A:
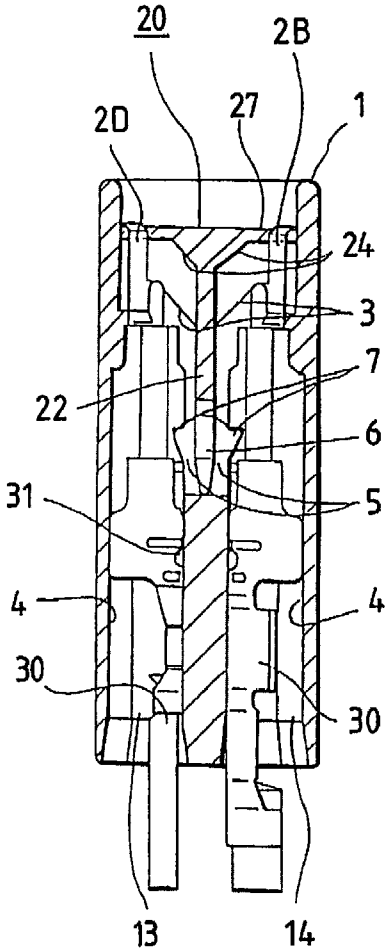

In FIGS. 3 (*a*) and (*b*), the fitting projections 27A and 27A, formed respectively on the opposite ends of the arm 27 of the retainer 20, are received in the fitting grooves 2B and 2D, and the retainer 20 is held in a provisionally retained condition in the connector housing 1.

The pair of metal terminals 30 and 30 are being inserted respectively into the terminal receiving chambers 13 and 14 along the guide grooves 4 and 4 from the lower side.

As shown in FIG. 3(*b*), in the provisionally-retained condition of the retainer 20, the projection 21A of the lock arm 21 is engaged with the projection 8A of the support wall 8 whereas the projection 22A of the lock arm 22 is engaged with the projection 9A of the support wall 9. As is clear from this Figure, the positions of engagement of these lock arms with the respective support wall projections are different, and therefore the lock arm 21 is liable to move downward while the lock arm 22 is liable to move upward. Therefore, the retainer 20 is liable to angularly move in a direction α in FIG. 3(*b*); however, since the fitting projections 26A and 27A on the ends of the arms 26 and 27 extending perpendicular to the sheet of this Figure are received in the fitting grooves 2A, 2B . . . , the degree of freedom of angular movement of the retainer 20 is extremely low, and therefore the angular movement in the direction α is prevented.

Figure 4:
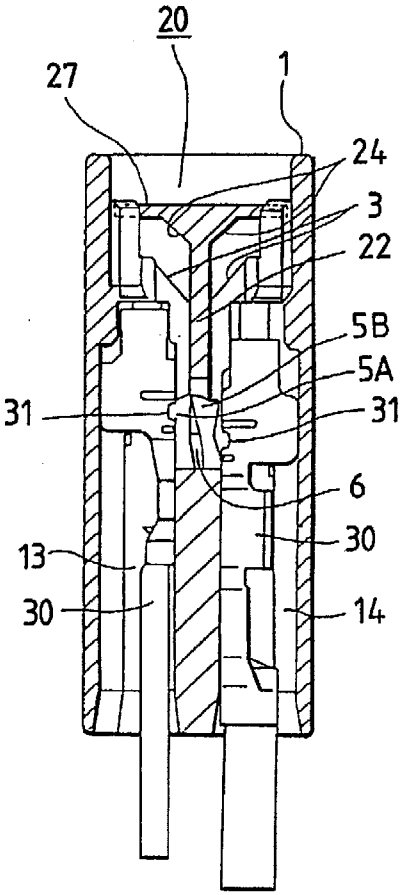
FIG. 4 is a side-elevational, cross-sectional view of the connector housing having the retainer provisionally retained thereon, showing the process of retaining the metal terminals.

As shown in FIG. 4, in the provisionally-retained condition of the retainer 20, the metal terminals 30 and 30 are inserted deep into the terminal receiving chambers 13 and 14, respectively, and are retained there. The retaining of the metal terminal 30 in the terminal receiving chamber 13 has been completed, and the elastic retaining piece 5A is retainingly fitted in a retaining hole 31.

The metal terminal 30 in the terminal receiving chamber 14 is being retained, and is moving upward, with its front end forcing the elastic retaining piece 5B toward the gap 6.

Figure 5B:
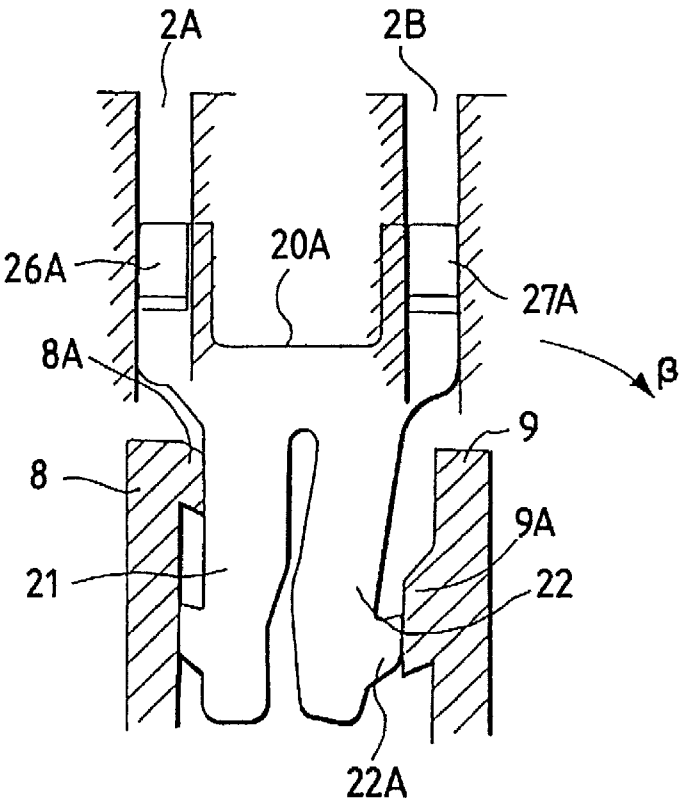
FIG. 5 (*a*) is a side-elevational, cross-sectional view showing the process of shifting of the retainer from its provisionally-retained position to its completely-retained position.
Figure 5A:
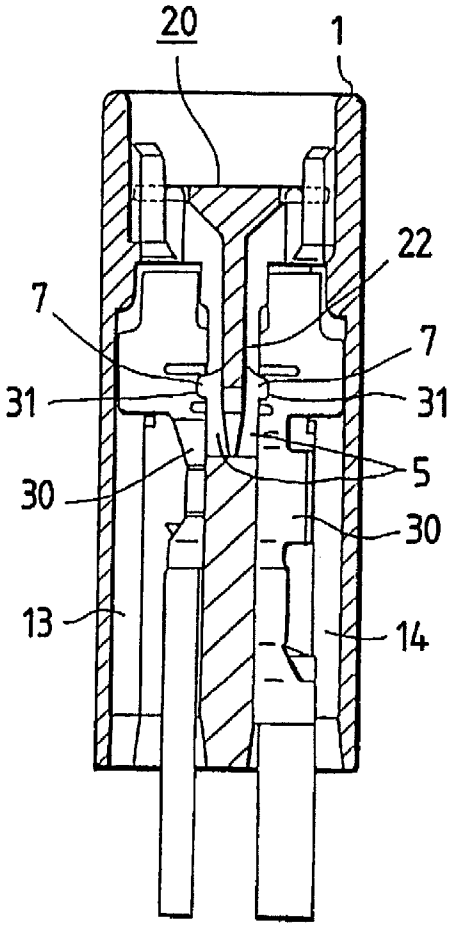

FIGS. 5 (*a*) and (*b*) show a condition in which the retainer 20 shifts from its provisionally-retained position to its completely-retained position after the metal terminals 30 and 30 are inserted deep respectively into the terminal receiving chambers 13 and 14, and are retained there. The retainer 20 is gradually pushed down, and the projection 22A of the lock arm 22 slides over the projection 9A of the support wall 9, so that this lock arm is deformed.

At this time, the retainer 20 tilts in a direction β in the drawings, or undergoes a force tending to angularly move the retainer; however, since the fitting projections 26A and 27A on the ends of the arms 26 and 27 are fitted respectively in the fitting grooves 2A, 2B . . . as described above, the degree of freedom of angular movement of the retainer is extremely low, and as a result the angular movement of the retainer in the direction β is prevented, as described above for the angular movement in the direction α.

Figure 6B:
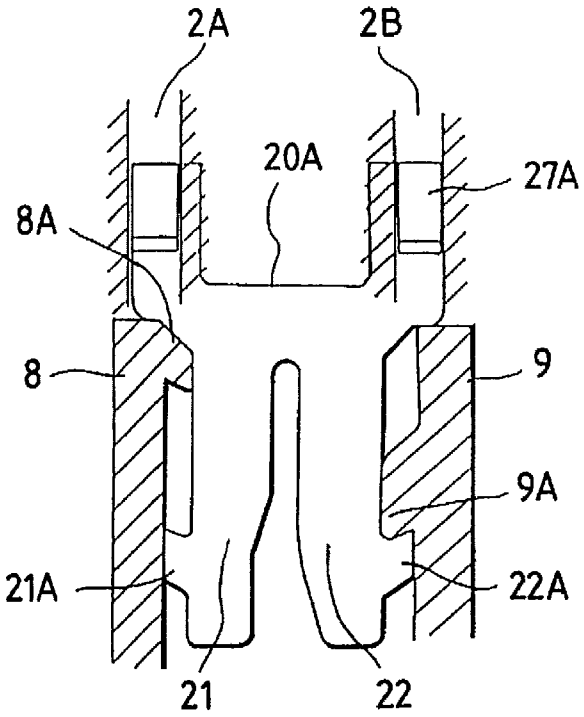
FIG. 6 (*a*) is a side-elevational, cross-sectional view of the connector housing having the retainer completely retained thereon, and having a fuse element attached thereto.
Figure 6A:
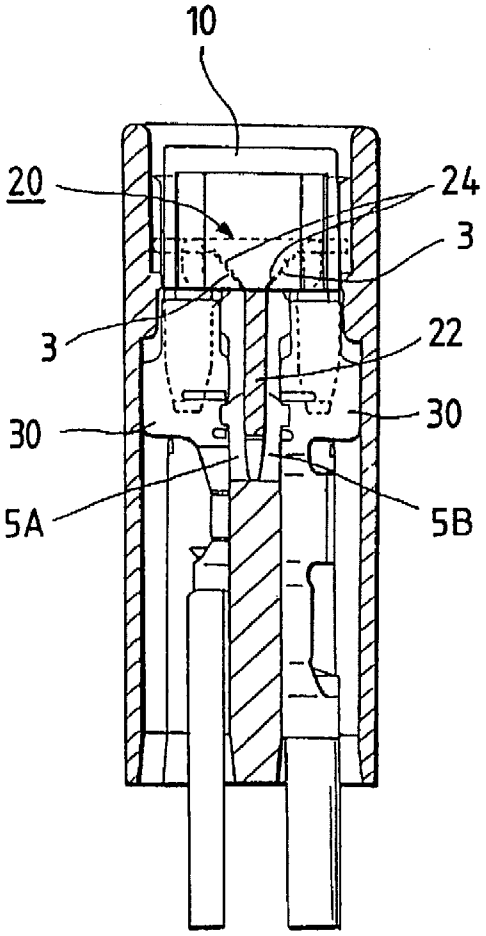
Figure 7A:
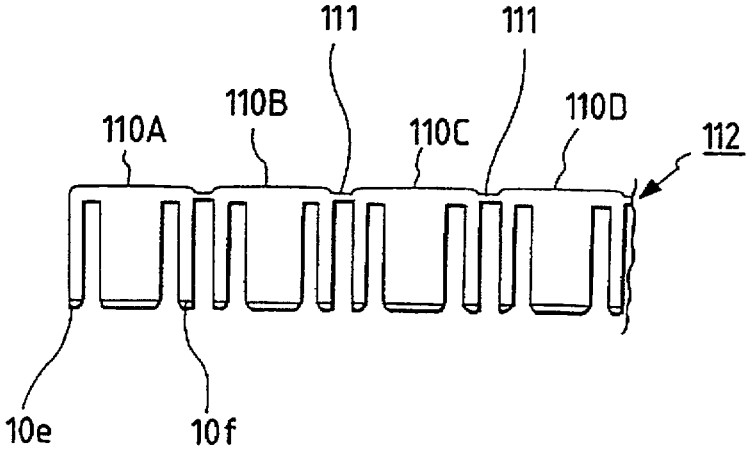
PRIOR ART FIG. 7(a)
FIGS. 7 (*a*) and (*b*) are views explanatory of a conventional retainer of the multi-interconnecting type.
Figure 7B:
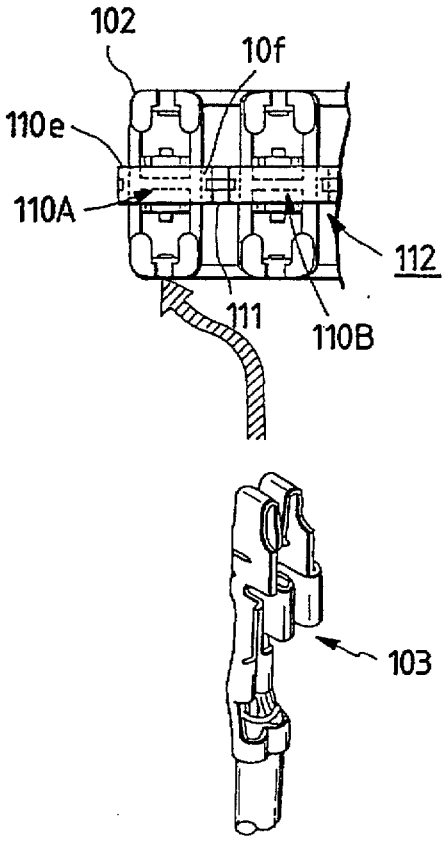
PRIOR ART FIG. 7(b)
Figure 8:
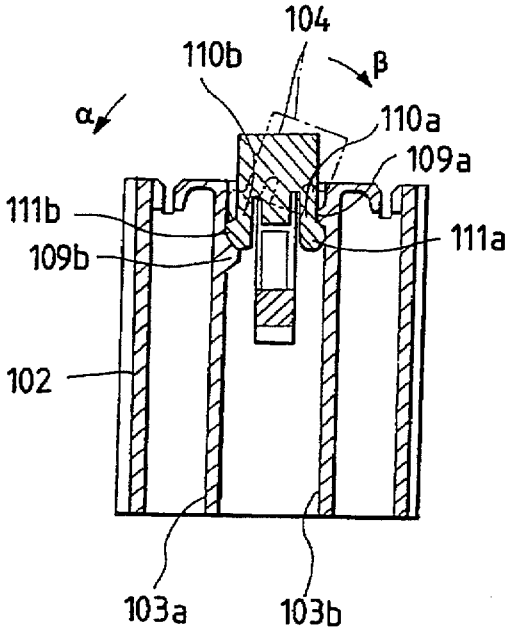
PRIOR ART FIG. 8
FIG. 8 is cross-sectional view of a connector having a conventional single-type retainer attached thereto.

Thereafter, when the projection 22A of the lock arm 22 passes past the projection 9A of the support wall 9 as shown in FIGS. 6 (*a*) and (*b*), the elastic retaining piece 5B is resiliently restored, and the lock arm 22 is fitted in the gap 6 (not shown in FIGS. 6 (*a*) and (*b*) for the sake of simplified illustration), so that the retainer 20 is completely retained.

In this completely-retained condition, the slanting surfaces 24 at the upper portion of the retainer 20 are engaged respectively with the slanting walls 3 of the housing, and the base portion 20A is engaged with the upper ends of the support walls 8 and 9.

And besides, since the projection 22A of the lock arm 22 is engaged at its upper end with the lower end of the projection 9A of the support wall 9, the retainer 20 is held against withdrawal, and hence is retained on the connector housing in a stable manner.

In this condition, a fuse element 10 is attached, and its terminals are engaged with the metal terminals 30 and 30, thus making electrical connection.

On the other hand, when the retainer is to shift in a reverse direction from the completely-retained condition to the provisionally-retained condition for maintenance purposes, or when the retainer is to be removed from the connector housing 1, such a shifting operation or such removal can be effected smoothly thanks to the fitting of the fitting projections in the fitting grooves, and therefore the above-mentioned disadvantages are overcome, and the operation can be carried out quite easily.

Moreover, even if the connector housing 1 is transported with the retainer 20 held in the provisionally-retained position, the retainer 20 will not shake because of the fitting of the fitting projections 26A and 27A in the fitting grooves 2A, 2B . . . , thus eliminating the possibility of an accident that the retainer 20 is disengaged during transport.

Incidentally, if the fitting grooves 2A, 2B . . . are formed utilizing grooves formed in a mold, there is achieved an advantage that the construction of the present invention can be provided more inexpensively and rapidly.

The positions of the illustrated fitting grooves, as well as the configuration thereof, are given merely as one example, and these fitting grooves may be provided at other positions, and may have other configuration. In short, the only requirement is to provide the fitting grooves of such a configuration near the retainer-retaining position that the ends of at least one pair of adequately-spaced arms on the base portion of the retainer can move upward and downward along these fitting grooves.

In the above embodiment, although the present invention is applied to the fuse box, the invention can, of course, be applied to the type of connector for connecting ordinary wires together.

In the connector construction of the above embodiment, although the plurality of pairs of front and rear terminal receiving chambers 13 and 14 are provided in a row in the right-left direction, the invention can be applied to the type of connector in which a plurality of terminal receiving chambers are arranged in a row in a right-left direction as in a half of the above fuse box obtained by dividing it in the forward-backward direction.

In a connector of such a construction, the retainers of the above embodiment can be connected together through the arms to provide a retainer of the multi-interconnecting type, in which case this retainer of the multi-interconnecting type can be engaged with a plurality of terminal receiving chambers from which a plurality of metal terminals need to be removed at a time, for example, when effecting the maintenance.

As described above, in the connector of the present invention, the two lock arms are retained on the support walls, and besides the opposite ends of the pair of arms are received in the plurality of fitting grooves, thereby suppressing the degree of freedom of angular movement of the retainer. Therefore, even when an asymmetrical external force is applied to the retainer through the asymmetrically-disposed projections on the support walls, the angular movement of the retainer in the illustrated directions α and β is suppressed. As a result, the stable provisionally-retained condition of the retainer is achieved, thereby eliminating an accident that the retainer is disengaged during transport. And besides, the removal of the retainer as well as the shifting of the retainer into the completely-retained position, can be carried out quite smoothly, thus achieving a much improved efficiency of the operation.

What is claimed is:

1. A connector comprising:

a connector housing (1) having a first set of projections (8A, 9A);

a retainer (20) for holding a terminal (30) against withdrawal form said housing, the retainer having a second set of projections (21A, 22A) which are retainingly engaged respectively with said first set of projections (8A, 9A) so that said retainer is engaged in one of a provisionally inserted position and a completely inserted position; and restraining means for restraining movement of said retainer in all directions except for an insertion direction and a removal direction of said retainer in said connector housing, wherein said restraining means comprises:

elongate arms (26, 27) formed on said retainer with a predetermined separation between said arms, said arms having fitting projections (26A, 27A) at opposite ends of each of said arms; and a plurality of fitting grooves (2A, 2B) formed in said connector housing for receiving, respectively, said fitting projections.

2. A connector as recited in claim 1, wherein said retainer is substantially H-shaped when viewed from a top of said retainer.

3. A connector as recited in claim 1, wherein said fitting projections on each one of said arms protrude in opposite directions from each other.

4. A connector comprising:

a connector housing (1) including:

terminal receiving chambers (13, 14) spaced apart in a first direction for receiving terminals (30, 30), respectively, said terminal receiving chambers having elastic retaining pieces (5A, 5B), respectively, said elastic retaining pieces having terminal retaining projections (7A, 7B), respectively for retaining said terminals; and a first set of projections (8A, 9A) for retaining a retainer (20) in one of a provisionally inserted position and a completely inserted position, said first set of projections being formed respectively on support walls (8, 9) spaced apart in a second direction perpendicular to said first direction;

a retainer (20) including elastic lock arms (21, 22) which extend from a base portion of said retainer, said lock arms having a second set of projections (21A, 22A), respectively, which engage said first set of projections for retaining said retainer in the provisionally inserted position and the completely inserted position; and restraining means for restraining movement of said retainer in all directions except for an insertion direction and a removal direction of said retainer in said connector housing, wherein said restraining means comprises:

fitting grooves (2A, 2B) formed in front and rear inner walls of said connector housing, said fitting grooves extending in the insertion direction and the removal direction of said retainer in said connector housing;

arms (26, 27) formed respectively on right and left sides of the base portion of said retainer, said arms extending transversely to the base portion; and fitting projections (26A, 27A) formed respectively on opposite ends of said arms, said fitting projections being received respectively in said fitting grooves so that said retainer is disposed for movement only in the insertion direction and the removal direction of said retainer in said connector housing.

5. A connector as claimed in claim 4, wherein said first direction is from a front side of said connector housing to rear side of said connector housing.

6. A connector as recited in claim 4, wherein said retainer is substantially H-shaped when viewed from a top of said retainer.

7. A connector as recited in claim 4, wherein said fitting projections on each one of said arms protrude in opposite directions from each other.

* * * * *